US007941888B2

(12) United States Patent
Bertoldi

(10) Patent No.: US 7,941,888 B2
(45) Date of Patent: May 17, 2011

(54) APPARATUS FOR CLEANING A WOODWIND INSTRUMENT

(76) Inventor: Bridget Bertoldi, Torrington, CT (US)

( * ) Notice: Subject to any disclaimer, the term of this patent is extended or adjusted under 35 U.S.C. 154(b) by 662 days.

(21) Appl. No.: 12/026,600

(22) Filed: Feb. 6, 2008

(65) Prior Publication Data

US 2009/0193597 A1 Aug. 6, 2009

(51) Int. Cl.
*A47L 25/00* (2006.01)
*G10D 9/00* (2006.01)

(52) U.S. Cl. ..... 15/88; 15/88.4; 15/97.1; 15/104.095; 84/453

(58) Field of Classification Search ..... 15/56, 65, 15/66, 88, 88.4, 97.1, 101, 104.095; 84/453
See application file for complete search history.

(56) References Cited

U.S. PATENT DOCUMENTS

| | | | | | |
|---|---|---|---|---|---|
| 1,421,529 | A | | 7/1922 | Millhouse | |
| 1,569,203 | A | | 1/1926 | Rice et al. | |
| 1,730,785 | A | | 10/1929 | Romao | |
| 2,239,047 | A | * | 4/1941 | Mathiessen | 15/164 |
| 2,327,986 | A | | 8/1943 | Bach | |
| 2,661,494 | A | * | 12/1953 | Crookston et al. | 15/387 |
| 2,866,212 | A | * | 12/1958 | White et al. | 15/88 |
| 3,164,491 | A | | 1/1965 | Brockett et al. | |
| 3,739,420 | A | | 6/1973 | Kafkis | |
| 4,114,504 | A | | 9/1978 | Koregelos | |
| 4,369,071 | A | | 1/1983 | Flach et al. | |
| 4,676,839 | A | * | 6/1987 | Osborn | 134/25.4 |
| 4,930,240 | A | | 6/1990 | Bice | |
| 5,060,336 | A | | 10/1991 | LaLonde | |
| 5,099,537 | A | | 3/1992 | Denny | |
| 5,212,332 | A | | 5/1993 | Gigliotti | |
| 5,416,944 | A | | 5/1995 | Eriksson | |
| 5,435,036 | A | * | 7/1995 | Hedrick et al. | 15/59 |
| 5,538,467 | A | * | 7/1996 | Wodajo | 452/119 |
| 5,555,588 | A | | 9/1996 | Viesehon | |
| 5,606,759 | A | * | 3/1997 | Yang | 15/75 |
| 5,829,088 | A | | 11/1998 | Ujihara et al. | |
| 5,937,470 | A | * | 8/1999 | Duncan | 15/88 |
| 5,940,920 | A | | 8/1999 | Hare et al. | |
| 6,467,121 | B1 | | 10/2002 | Franzino et al. | |
| 6,757,929 | B1 | | 7/2004 | Snelson | |
| 6,964,077 | B2 | | 11/2005 | Kadinger | |
| 7,055,203 | B1 | | 6/2006 | Franzino | |
| 2001/0042277 | A1 | | 11/2001 | Reichborn | |
| 2006/0130251 | A1 | | 6/2006 | Bourrelly | |

* cited by examiner

*Primary Examiner* — Randall Chin
(74) *Attorney, Agent, or Firm* — McCormick, Paulding & Huber LLP

(57) ABSTRACT

The present invention provides an apparatus for cleaning a woodwind instrument including a housing and a motor mounted within the housing, the motor having a rotatable drive shaft extending outwardly from the housing. An elongated cleaning tool is coupled to the drive shaft and insertable into the tube portion of a woodwind instrument for cleaning the inner wall of the tube. The apparatus further includes an instrument support attached to the housing adjacent the cleaning tool. The instrument support defines a length aligned substantially parallel with the length of the cleaning tool for supporting the instrument during a cleaning process. The cleaning tool being rotatable via the drive shaft for cleaning the interior of an instrument positioned over the cleaning tool and supported by the instrument support. A strap is provided to secure the instrument to the instrument support.

17 Claims, 3 Drawing Sheets

APPARATUS FOR CLEANING A WOODWIND INSTRUMENT

FIELD OF THE INVENTION

The present invention generally relates to woodwind instruments, and more particularly, to an apparatus for cleaning the tube of a woodwind instrument.

BACKGROUND OF THE INVENTION

Most currently used woodwind instruments are usually cleaned by hand using a cloth swab attached to a string or shaft for removing moisture and reducing odors which may accumulate within the tubes of the various sections of an instrument. Typically, a swab with an attached string includes a small weight coupled to the string at an end thereof opposite the swab. To use the swab, the weight is dropped through the jointed sections of the tube of the instrument. The swab is then gently pulled through the instrument using the string thereby wiping the inner wall of the tube of the instrument with the swab. Depending on the application, the sections of the instrument may be cleaned together or individually.

Alternatively, a swab attached to an elongated shaft, such as the Flute Flag available through the Flute World Co. of Franklin, Mich., can be inserted into the tube of an instrument and rotated manually to clean the body, footjoint and headjoint of a flute or similar sections of another type of woodwind instrument. Other types of cleaning rods available define a slotted opening for receiving a swab and removably attaching the swab to the rod. The rod is then used for cleaning a flute or other type of woodwind instrument by manually inserting the rod and attached swab into the tube of the instrument to clean the inner wall of the tube.

One disadvantage of the above-described prior art cleaning tools is that these type of swab tools are manually operated and therefore time consuming to use. Usually, to properly clean an instrument, a cleaning process using a manually operated swab to wipe down the inner wall of the tube of an instrument may have to be repeated numerous times thereby extending the time required to clean the instrument.

Another disadvantage of the shaft type prior art cleaning tools described above, is that these tools are typically used with only one section of a woodwind instrument at a time such that this time consuming manual process is protracted by the number of sections of the instrument being cleaned.

Based on the foregoing, it is the general object of the present invention to provide an apparatus for cleaning the tube of a woodwind instrument that improves upon, or overcomes the problems and drawbacks associated with prior art cleaning tools.

SUMMARY OF THE INVENTION

The present invention provides an apparatus for cleaning the tube of a woodwind instrument including a housing and a motor mounted within the housing, the motor having a rotatable drive shaft extending outwardly of the motor. An elongated cleaning tool is coupled to the drive shaft and insertable inside the tube portion of an instrument, the cleaning tool being engagable with the inner wall of the tube for cleaning the tube. The apparatus further includes an instrument support attached to the housing adjacent the cleaning tool. The instrument support has an arm aligned substantially parallel with the cleaning tool for supporting the instrument during a cleaning process. The cleaning tool is rotatable via the drive shaft for cleaning the interior of the tube of an instrument positioned over the cleaning tool and supported by the instrument support. A strap attached to the instrument support releasably secures an instrument thereagainst during a cleaning process.

In a preferred embodiment, the instrument support further includes a cushion for engaging an outer surface of the instrument and supporting the instrument thereagainst.

A tool chuck is attached to the end of the drive shaft for releasably coupling the cleaning tool to the drive shaft. The motor is controllable to adjust the speed and direction of rotation of the cleaning tool.

DETAILED DESCRIPTION OF EMBODIMENTS OF THE INVENTION

Figure 1:
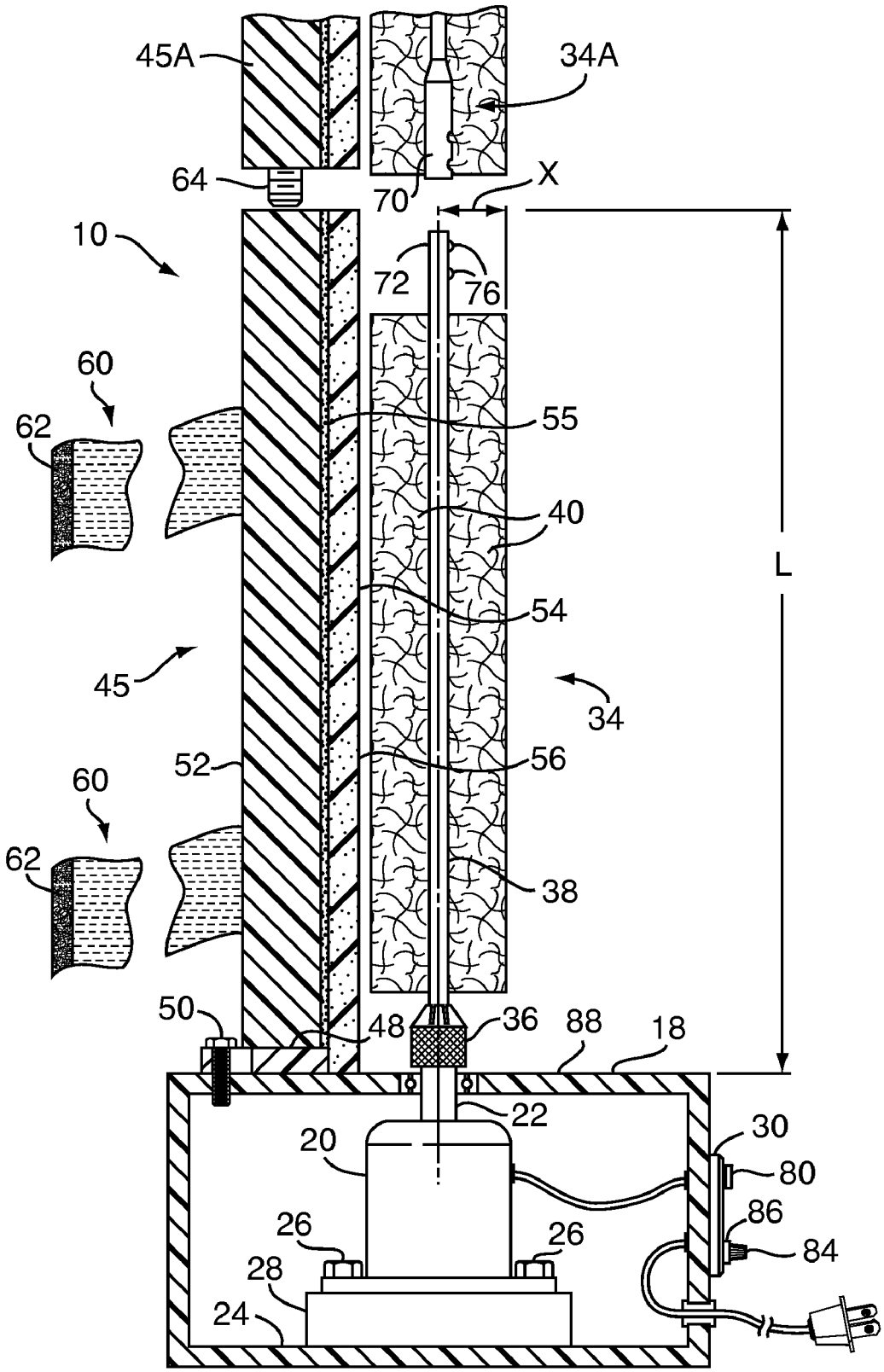
FIG. 1 is a partially sectional side elevational view of an apparatus for cleaning a woodwind instrument according to the present invention.
Figure 2:
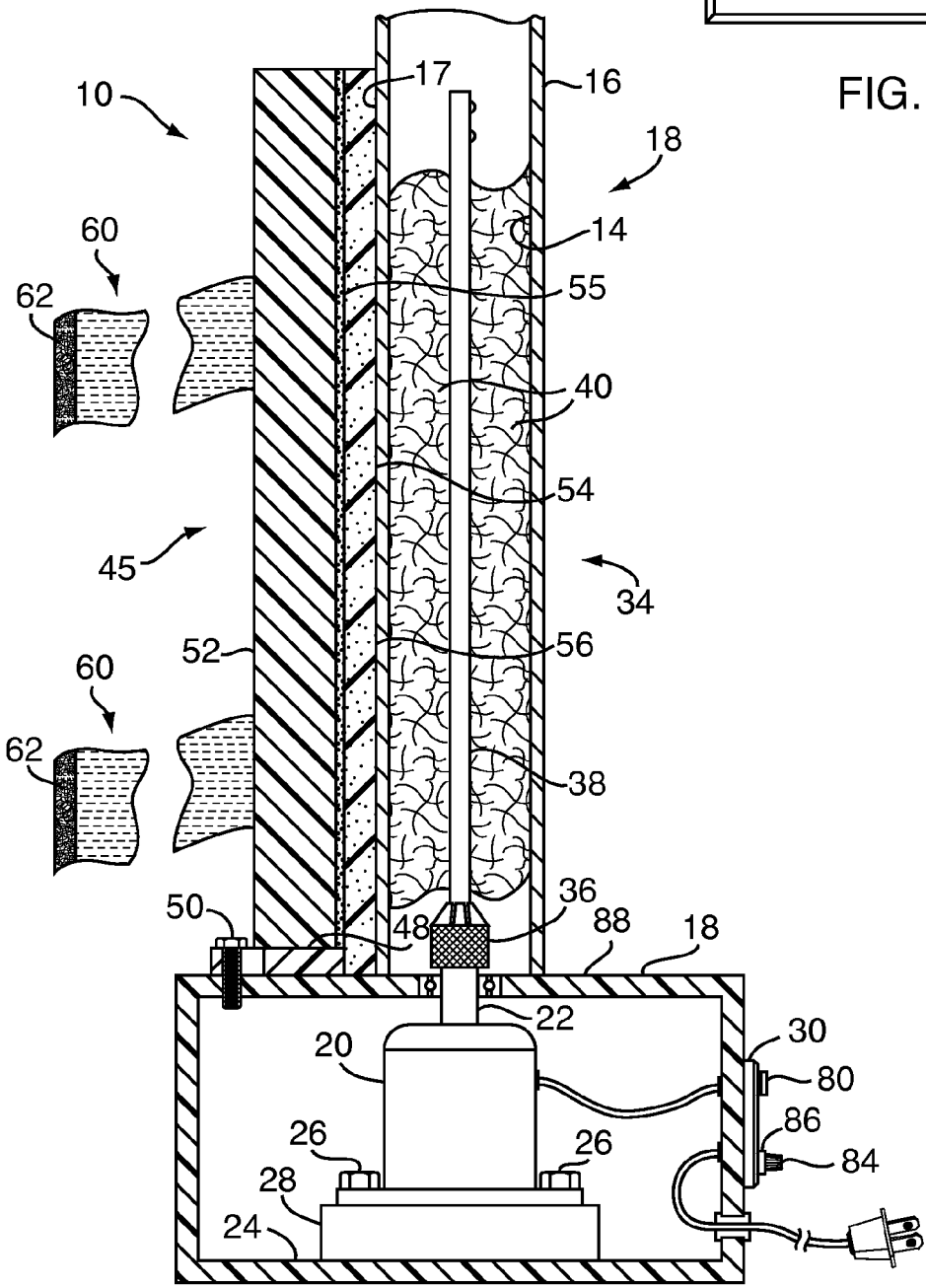
FIG. 2 is a partially sectional side elevational view of the apparatus of FIG. 1 shown with a tube portion of an instrument mounted thereon.

Referring to FIG. 1, one embodiment of an apparatus for cleaning the tube of a woodwind instrument according to the present invention is generally designated by the reference number 10. FIG. 2 shows a tube portion 16 of a woodwind instrument coupled to the apparatus 10 for cleaning the inside wall 14 of the tube portion of the instrument.

The apparatus 10 includes a housing 18 enclosing an electric motor 20 with a rotatable drive shaft 22. The motor 20 is mounted to a bottom wall 24 of the housing via bolts 26 with a damper 28 mounted between the motor and the housing. The damper 28 reduces the transfer of mechanical vibration from the motor 20 to the housing 18. A control panel 30 mounted to the housing 18 includes a plurality of switches and/or indicators for controlling the motor 20.

A cleaning tool 34 is coupled to the drive shaft 22 and the motor 20 via a tool chuck 36. The tool chuck 36 includes a plurality of movable jaws (not shown) for removably grasping a shaft 38 of the cleaning tool 34 and coupling the cleaning tool to the drive shaft 22 in a well known manner. In other embodiments of the present invention other types of couplers could be used to removably attach the cleaning tool 34 to the drive shaft 22.

The shaft 38 of the cleaning tool 34 is elongated and includes one or more wipers 40 extending outwardly from the shaft along substantially the entire length thereof. As shown in FIG. 1, each of the wipers 40 has a width designated by the letter "X", extending radially outward from the shaft 38 (measured generally perpendicular to an axis of the shaft 38 from the center of the shaft). The width X of a given wiper is selected in accordance with the diameter of the instrument such that the wiper engages the inner wall 14 of the tube portion 16 of the instrument when the tube portion of the instrument is placed over the cleaning tool 34. Typically, the wiper 40 is manufactured from a soft flexible material so that a wiper having a certain width X may be appropriate for use with the instrument as well as other instruments having tube portions with inner diameters of a given range. Thus, the wiper 40 will engage the inner wall thereof when rotated by the drive motor 20. For example, a wiper 40 may be useful for cleaning various flutes or other instruments even though the instruments may include body portions which define tubes portions 16 of various diameters. Typically, however, the wiper 40 has a length and width which is best used with a particular type of instrument. For example, a wiper 40 for use with a clarinet may be considerably larger than a wiper designed for use with a flute.

Preferably, the wiper 40 is manufactured from a soft material such as a chamois, or a cloth such as felt, silk or cotton.

In other embodiments of the present invention, the wiper 40 of the cleaning tool 34 may be an elongated pad coupled to the shaft 38. The pad can be made from foam, sponge, cloth or synthetic material suitable to clean the interior of a tube portion 16 of an instrument without damaging the surfaces thereof. The pad may have a cross-section having a circular, triangular or other shape such that the edges/surface of the pad engage the interior of an instrument to be cleaned when the tube portion 16 of the instrument is positioned over the pad. Alternatively, the cleaning tool 34 can include an elongated soft brush for engaging the inner wall 14 of the tube 16.

Preferably, the wiper 40 of the cleaning tool 34 is removable from the shaft 38 for cleaning, replacement and/or disposal thereof. In one embodiment, the wiper 40 is in the shape of a sleeve for receiving the shaft 38 such that the wiper is installed on the shaft by sliding the sleeve over the shaft. Alternatively, the shaft 38 can include a two-part shaft wherein the wiper 40 is secured between the two parts of the shaft. Typically, the wiper 40 can be cleaned by removing the same from the shaft 38 and washing the wiper with soap and water, rinsing the wiper, and allowing the wiper to dry prior to reinstalling the wiper onto the shaft. Alternatively, a disposable wiper 40 can be used wherein a used wiper is removed and disposed and a new wiper is installed on the shaft 38.

Referring to FIGS. 1 and 2, the apparatus 10 further includes an elongated instrument support 45 mounted to the housing 18 adjacent the cleaning tool 34. The instrument support 45 has a length "L" and is aligned substantially parallel with the cleaning tool 34 for supporting the instrument during a cleaning process. (See FIG. 1). In the illustrated embodiment, the instrument support 45 is attached to the housing 18 at a base plate 48 of the instrument support via clamping bolt 50 inserted through slots in the base plate and threaded into the housing. The instrument support 45 includes an elongated upright arm 52 attached to the base plate 48 and extending vertically outwardly from the housing 18 generally parallel to the shaft 38 of the cleaning tool 34. The upright arm 52 includes a cushion 54 having a cushioned surface 56 extending along the length of the upright arm on a side thereof facing the cleaning tool 34. The cushioned surface 56 of the cushion 54 engages an outer wall 17 of the tube 16 when the instrument is coupled to the apparatus 10. Preferably, the cushion 54 is made of a soft resilient foam or other material which will protect the tube portion 16 and any keys, pads, tone, holes, operating linkages, and other parts of the instrument when the instrument is installed over the cleaning tool 34 and supported by and/or against the instrument support 45.

In one embodiment, the cushion 54 is adhered to the upright arm 52 via an adhesive layer 55 disposed between the cushion and the upright arm. In other embodiments, the cushion 54 is attached to the upright arm 52 via fasteners such as screws (not shown) such that the cushion can be removed from the upright arm and be separately replaced if necessary. In one embodiment of the apparatus 10, the upper surface 88 of the housing 18 also includes a cushioned surface so that the lower end of an instrument is supported on a cushioned surfaced for protecting the instrument during use of the apparatus 10.

The instrument support 45 includes straps 60 for securing the instrument to the upright arm 52 during a cleaning process. In the FIG. 2 embodiment, each strap 60 has one end attached to the upright arm 52 and includes hook and loop style fastener portions 62, such as Velcro®, affixed to opposing ends of the strap, or to one end of the strap and to the upright arm 52. The straps 60 are designed to wrap around the tube portion 16 of the instrument and secure the tube portion against the cushioned surface 56 of the upright arm 52.

Referring to FIG. 1, the instrument support 45 and the cleaning tool 34 are extendable in length to accommodate instruments or portions of instruments which are longer than the cleaning tool 34. The instrument support 45 includes an instrument support extension 45A which is removably attachable to the instrument support 45 for extending the length thereof. A fastener 64, such as a threaded lug, is provided to attach the instrument support extension 45A to the instrument support 45.

Similarly, a cleaning tool extension 34A is provided to extend the length of the cleaning tool 34 for use with longer instruments. The cleaning tool extension 34A includes a socket and flange 70 configured to receive an end 72 of the cleaning tool shaft 38 for removably attaching the cleaning tool extension 34A to the cleaning tool 34. In the illustrated embodiment, the socket end has lateral holes, and the 72 of the cleaning tool shaft 38 includes a pair of springed detents 76, matching the holes for fixing the position of the cleaning tool extension 34A relative to the cleaning tool 34. Alternatively, other types of couplers may be utilized to attach the cleaning tool extension 34A to the cleaning tool 34 as will be apparent to one skilled in the art.

In a preferred embodiment, the instrument support 45 is slideable relative to the housing 18 toward and away from the cleaning tool 34 by virtue of the slotted base plate 48 and clamping bolt 50. Accordingly, the position of the instrument support 45 can be adjusted relative to the housing 18 and the cleaning tool 34 to accommodate various sized instruments and the various cleaning tools 34 used therewith. For example, when using the apparatus 10 with a clarinet, a cleaning tool 34 having a wider wiper 40 may be required as opposed to a narrower cleaning tool 34 designed for use with a flute. Additionally, the space between the shaft 38 of the cleaning tool and the cushioned surface 56 of the instrument support 45 may need to be adjusted to accommodate a clarinet, which typically has a larger diameter tube portion than a flute. Thus, the base plate 48 of the instrument support 45 has slots for receiving the bolts 50 such that the position of the instrument support relative to the housing 18 is adjustable radially relative to the cleaning tool as discussed hereinabove. Preferably, the upper surface 88 of the housing 18 defines markings for indicating the appropriate position of the instrument support 45 relative to the housing for various standard sized woodwind instruments.

Figure 3:
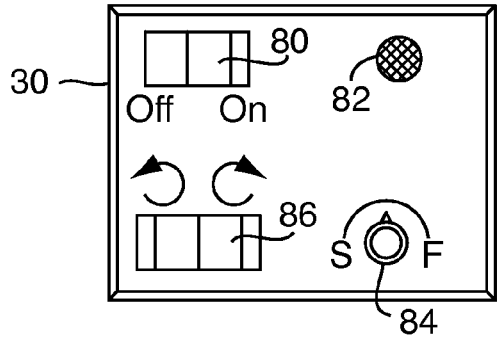
FIG. 3 is a front view of one embodiment of a control panel of the apparatus of FIG. 1.

Referring to FIG. 3, the control panel 30 includes an ON/OFF switch 80 and associated indicator light 82 for controlling the motor 20. Switches 84 and 86 control the speed and direction of rotation of the drive shaft 22, respectively. Depending on the application, a relatively low speed for the drive shaft 22 is sufficient for cleaning the tube 16 of a woodwind instrument such as in a range of about 10 to about 300 revolutions per minute (rpm). In a preferred embodiment of the apparatus 10, the shaft speed for the drive shaft 22 is in a range of about 80 to about 150 rpm.

The direction of rotation of the drive shaft 22 is also controllable via a switch 86 on the control panel 30. Depending on the configuration of the tube portion 16 of the instrument, the orientation of the instrument relative to the apparatus 10, and the configuration of the cleaning tool 34 being used, the drive shaft 22 can be set to rotate in either a clockwise or counterclockwise direction relative to the housing 18.

Figure 4:
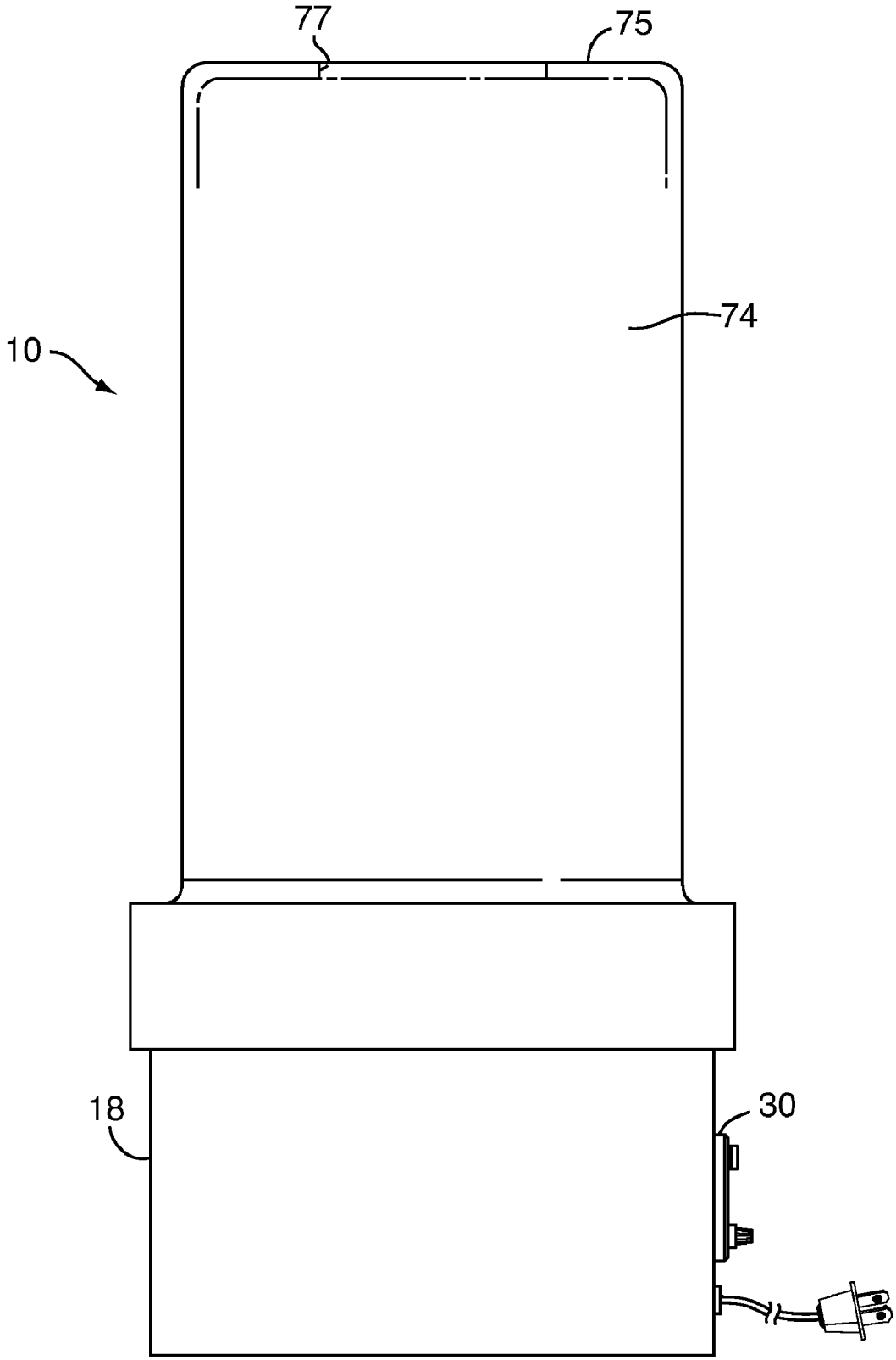
FIG. 4 is a side elevational view of the apparatus of FIG. 1 shown with a cover attached thereto.

Referring to FIG. 4, the apparatus 10 includes a removable cover 74 which rests on the housing 18 for enclosing the cleaning tool 34 and instrument support 45 during a cleaning operation. In one embodiment of the present invention, the cover 74 includes a closed top surface 75 wherein if a flute or other instrument extends beyond a height of the cover, the cover cannot be installed while the instrument is attached the apparatus 10. Alternatively, in other embodiments of the cover 74, the top surface 75 of the cover defines an opening 77 therethrough such that one or more of the cleaning tools 34, the instrument support 45, extensions to the cleaning tool and instrument support, and an instrument, can extend through the opening while the cover is in place on the housing 18.

In one embodiment of the apparatus 10, the housing 18 and cover 74 are cylindrical and include a threaded joint therebetween such that the cover threadably engages the housing. In other embodiments, the cover 74 includes a collar portion which is sized to receive an upper portion of the housing in a box/lid arrangement. Alternatively, in other embodiments, a seal (not shown) such as a gasket or O-ring is provided between the cover 74 and housing 18.

In use of the apparatus 10, the tube portion 16 of an instrument can be cleaned using the apparatus 10 by positioning the tube over the cleaning tool 34 such that the wiper 40 of the cleaning tool extends inside the tube and engages the inner wall 14 thereof. The lower end of the tube portion 16 resting on and is supported by the upper surface 88 of the housing 18. The straps 60 are then wrapped around the outer wall 17 of the tube portion 16 and secured using the fasteners 62 such that the outer wall 17 of the tube portion 16 engages and is held against the cushioned surface 56 of the instrument support 45.

Once the instrument is secured to the apparatus 10 as set forth above, the cover 74 can be installed over the instrument if desired and attached to the housing 18 as shown in FIG. 4. With or without the cover 74, a user continues the cleaning process by setting the speed control switch 84 to a desired speed of rotation of the cleaning tool 34. The direction of rotation of the shaft can also be set using the switch 86. Once the speed and rotation of the cleaning tool is set, the On/Off switch 80 is used to turn the motor 20 on thereby causing the cleaning tool 34 to rotate within the tube portion 16 of the instrument and clean the same via the wiper(s) 40 engaging the inner wall 14 of the tube portion 16. Once the inner wall 14 of the tube portion 16 is deemed to be cleaned and/or polished, the On/Off switch 80 is used to turn the motor 20 off and stop the cleaning process. The instrument can then be removed from the apparatus by loosening the straps 60 and removing the tube portion 16 from the cleaning tool 34. Thereafter, another portion of the instrument can be cleaned, or another instrument, by repeating the steps set forth above.

Depending on the condition of the instrument and the degree of cleanliness desired, the time required for the cleaning process is determined by a user of the apparatus 10. Cleaning solutions and/or polishes may be used with the apparatus 10 depending on the application and the structure of the cleaning tool 34.

The foregoing description of embodiments of the invention has been presented for the purpose of illustration and description, it is not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. An apparatus for cleaning the tube of a woodwind instrument comprising:

a housing;

a motor mounted within the housing and having a rotatable drive shaft;

an elongated cleaning tool coupled to the drive shaft and insertable into the tube portion of a woodwind instrument, the cleaning tool being engagable with the inner wall of the tube for cleaning the tube;

an instrument support attached to the housing adjacent the cleaning tool having an arm aligned substantially parallel with the cleaning tool for supporting an instrument over the cleaning tool during a cleaning process; and a strap for securing an instrument to the instrument support.

2. The apparatus according to claim 1 wherein the arm of the instrument support includes a cushion for supporting the instrument thereagainst.

3. The apparatus according to claim 1 wherein the drive shaft includes a chuck for releasably coupling the cleaning tool to the drive shaft.

4. The apparatus according to claim 1 wherein the cleaning tool includes a replaceable cleaning element.

5. The apparatus according to claim 1 wherein the instrument support is adjustably coupled to the housing for movement toward and away from the cleaning tool for use with instruments having various diameters.

6. The apparatus according to claim 1 further comprising a cover attachable to the housing.

7. The apparatus according to claim 1 wherein the cleaning tool includes an extension attachable thereto for extending the length of the cleaning tool.

8. The apparatus according to claim 1 wherein the arm of the instrument support includes an extension attachable thereto for extending the length thereof.

9. An apparatus for cleaning the tube of a woodwind instrument comprising:

a base;

a motor having a rotatable drive shaft mounted to said base;

an elongated cleaning tool coupled to said drive shaft for rotation relative to said base;

an instrument support attached to the base adjacent the cleaning tool and bearing an arm aligned substantially parallel with the length of the cleaning tool for supporting an instrument during a cleaning process, the arm including a cushioned abutment surface for supporting the instrument, the abutment surface defined by a foam layer; and the cleaning tool being rotatable via the drive shaft for cleaning the interior of an instrument positioned over the cleaning tool and supported by the instrument support.

10. The apparatus according to claim 9 wherein the instrument support further includes attachment means for releasably coupling an instrument to the instrument support for supporting the instrument during a cleaning process.

11. The apparatus according to claim 10 wherein said attachment means includes a strap having a hook and loop fastener.

12. The apparatus according to claim 9 wherein the cleaning tool further comprises a flexible wiper extending outwardly from an axis thereof for engaging an interior wall of a tube portion of an instrument.

13. The apparatus according to claim 9 further comprising a tool chuck attached to the drive shaft of the motor for releasably coupling said cleaning tool to said drive shaft.

14. The apparatus according to claim 9 wherein the cleaning tool includes an extension attachable thereto for extending the length of the cleaning tool.

15. The apparatus according to claim 9 wherein the arm of the instrument support includes an extension for extending the length of the arm.

16. The apparatus according to claim 9 further comprising an instrument cover attachable to the base for enclosing at least a portion of an instrument coupled to the instrument support during a cleaning process.

17. The apparatus according to claim 9 further comprising a damper mounted between the motor and the base.

* * * * *